US005360324A

United States Patent [19]

Levington et al.

[11] Patent Number: 5,360,324

[45] Date of Patent: Nov. 1, 1994

[54] RECIPROCATING VACUUM PUMPS

[75] Inventors: Henry J. Levington, Snelland; Stephen R. Earle, Pudsey, both of United Kingdom

[73] Assignee: Wabco Automotive (UK) Limited, Warwickshire, England

[21] Appl. No.: 119,145

[22] PCT Filed: Mar. 23, 1992

[86] PCT No.: PCT/GB92/00531

§ 371 Date: Oct. 28, 1993

§ 102(e) Date: Oct. 28, 1993

[87] PCT Pub. No.: WO92/16749

PCT Pub. Date: Oct. 1, 1992

[30] Foreign Application Priority Data

Mar. 21, 1991 [GB] United Kingdom ..... 9106047.5

[51] Int. Cl.[5] ..... F04B 37/14; F04B 39/02; F04B 39/04; F04B 39/12

[52] U.S. Cl. ..... 417/534; 184/24; 92/240; 92/153

[58] Field of Search ..... 417/228, 534; 184/24; 92/153, 175, 240

[56] References Cited

U.S. PATENT DOCUMENTS

| | | | |
|---|---|---|---|
| 2,188,106 | 1/1940 | Caldwell | 92/175 |
| 2,216,353 | 10/1940 | Park | 92/175 |
| 2,668,656 | 2/1954 | Booth et al. | 417/534 X |
| 4,055,950 | 11/1977 | Grossman . | |
| 4,214,507 | 7/1980 | Hock et al. | 92/240 X |
| 4,694,734 | 9/1987 | Nomura et al. . | |
| 4,976,591 | 12/1990 | Rivas et al. . | |

FOREIGN PATENT DOCUMENTS

| | | |
|---|---|---|
| 4007252 | 9/1990 | Germany . |
| 59-206685 | 11/1984 | Japan . |
| 2-230983 | 9/1990 | Japan . |
| 2114681 | 8/1983 | United Kingdom . |

*Primary Examiner*—Richard E. Gluck

*Attorney, Agent, or Firm*—Meltzer, Lippe, Goldstein, Wolf, Schlissel & Sazer

[57] ABSTRACT

A reciprocating vacuum pump has a disc shaped piston (22, 122) having a peripheral elastomeric seal (52, 152) with oppositely directed, radially outwardly extending skirt portions (54,56); the piston is driven axially by a rod (34, 134) reciprocal in a lubricated bearing (42, 142) and a lubrication flowpath (50,48; 150,148) is defined between the bearing (42, 142) and the side of the piston (22, 122) opposite thereto.

10 Claims, 4 Drawing Sheets

RECIPROCATING VACUUM PUMPS

This invention relates to a reciprocating pump, more particularly though not exclusively a reciprocating vacuum pump of the kind used to evacuate a vehicle braking servo predominantly on vehicles driven by diesel engines.

Such vacuum pumps or so-called exhausters are usually mounted on the cylinder head or the crankcase of the engine to be operated by an engine-driven cam acting on the piston or push-rod. For the purpose of lubrication, oil from the crankcase may be led or allowed to leak into the pumping chamber and by virtue of the convenient engine crankcase mounting discharged directly into the crankcase.

However, the necessary orientation and/or disposition of the pump in any particular application is not always conducive to adequate lubrication, so that a special oil supply has to be provided.

Another consideration in the manufacture of such pumps is to facilitate the control of component tolerances, and in this and other ways to avoid or minimise high cost machining and assembly operations. More specifically, it would be highly advantageous to avoid accurate machining of the cylinder bore and the piston rod bearing concentric therewith; indeed, in the ideal, to enable construction of a pump from cast, forged or stamped elements not requiring machining. It will be understood that such considerations also go to the need for adequate lubrication and sealing, at least to the extent required to compensate for deviations in concentricity and surface finish as a result of using unmachined components.

It is particularly important to ensure adequate lubrication in automotive applications because the vacuum pump is usually driven by the vehicle camshaft and may reciprocate at 2000 to 2500 strokes per minute. The problem of adequate lubrication is exacerbated when pumps having a large bore/stroke ratio are employed, typically greater than 2, because of the need to ensure a low profile pump body on overhead camshaft engines.

According to one aspect of the invention there is provided a reciprocating vacuum pump having a cylinder, a substantially disc shaped piston reciprocal in the cylinder and said piston being driven axially by a rod running in a lubricated bearing, said piston having a peripheral seal of resilient material and said seal having peripheral skirt portions extending radially outwardly and in opposite directions, characterized in that a lubrication flowpath is provided between said bearing and the cylinder space on the side of said piston remote from the bearing. The skirt portions thus provide substantially conical sealing lands directed axially of the piston in opposite directions and providing a substantially uni-directional sealing action. The seal is formed of a low friction material, preferably an ethylene/acrylic elastomer such as VAMAC (registered trademark). Such a seal is able to accommodate taper and ovality and the flexibility and the self generating capabilities of the seal can be made appropriate to the hardness grade of the material, the hardness grade being selected to suit the surface texture and abrasive properties of the cylinder bore.

The seal may be generally Y-shaped and fitted to float in a groove around the piston but in a preferred embodiment is bonded directly to the piston. One advantageous feature arising from the use of such bonded seals is that the seal may have projecting portions moulded integrally with the seal and shaped to fit into cylinder end spaces so filling otherwise "dead" spaces and yielding an improved compression ratio.

Reciprocating vacuum pumps for automotive applications are generally mounted directly on the engine, oil spilling from the camshaft lubrication system serving to lubricate the piston rod bearing of the pump. In the absence of any specific supply, the only oil available for lubrication of the seal enters the pump through the piston rod bearing. Thus it is essentially marginal and enters only the space on the said one side of the piston. The lip of the peripheral skirt portion extending to the said one side of the piston allows sufficient oil to pass to avoid a "dry-edge" which would cause lip damage but retains the oil to avoid the loss of pumping efficiency. There may not therefore be sufficient oil to reach the sealing lip remote from the bearing.

In accordance with the invention a lubrication flowpath is provided to the side of the piston remote from the bearing, thus ensuring adequate lubrication of the sealing lip remote from the bearing. It is essential that such a lubrication path does not impair the performance of the pump.

In the preferred embodiment the lubrication flowpath comprises a cross hole disposed longitudinally of the piston rod in a portion thereof which is received within the bearing and communicating with a hole extending longitudinally of the piston rod and opening into the cylinder space at the said other side of the piston. Such an arrangement is particularly advantageous since the passage of oil along the flowpath is assisted by the pumping action of the rod reciprocating in the bearing.

Thus, the lip on each peripheral skirt portion of the seal can receive sufficient lubrication to ensure effective operation when the cylinder bore is not machined but has, for example, a cast finish.

An important aspect of the invention is that the cross hole is preferably always covered by the rod bearing, there is thus no depletion of pumped vacuum and pumping efficiency is maintained. Furthermore vacuum generated in the pumping chamber(s) draws oil from the bearing clearance into the chamber, and the flowpath cross sections (hole sizes) may be chosen to ensure that the amount of oil is adequate but not excessive.

In a preferred embodiment the peripheral skirt portions of the seal do not extend axially beyond the opposed piston walls, thus ensuring maximum pumping volume in a cylinder having end walls substantially orthogonal to reciprocation axis.

Embodiments of the invention will now be described with reference to the accompanying drawings in which.

Figure 1:
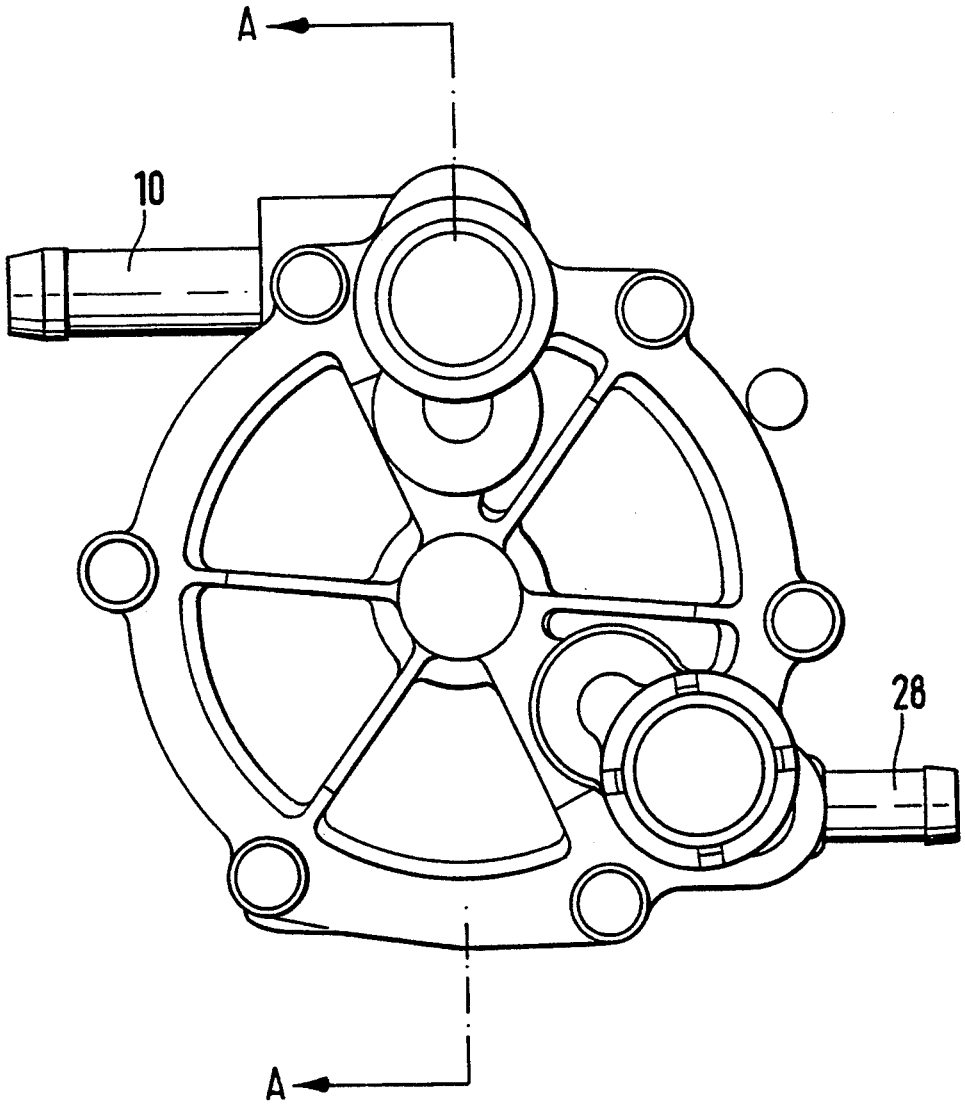
FIG. 1 is en end elevation of a vacuum pump.

The double-acting vacuum pump of FIGS. 1 to 4 has a suction port 10 communicating via a manifold 12 and respectively via non-return inlet valves 14 and 16 with cylinder spaces 18 and 20 on opposite sides of a piston 22 working in a cylinder bore 24. The cylinder spaces 18 and 20 each communicate via exhaust valves 26 (one shown) with a delivery port 28.

The vacuum pump housing has a flange 30 by means of which the pump is mounted on the crank case of an engine to be driven by a cam operated mechanism (not shown) acting on the plunger 32 driving the piston rod 34 against the action of a return spring 36 disposed around a bearing boss 38 integral with the pump housing and held captive by a retaining member 40 fitted on the piston rod.

The piston rod runs in a sleeve of bearing material 42 (such as sintered bronze or PTFE in a sintered and rolled matrix in a steel backing bush) inserted within the bearing boss (38). The piston rod 34 is a pressed fit in a hub 44 of the piston disc 46 and has extending longitudinally along the axis thereof a drilled hole 48 communicating between the cylinder space 18 and a cross hole 50 communicating with a clearance space between the piston rod 34 and the bearing sleeve 42. The cross hole 50 is positioned at a distance from the leading end of the bearing sleeve 42 that is greater than the piston stroke.

The bearing may alternatively be defined by a simple bore in the body of the pump.

Figure 3:
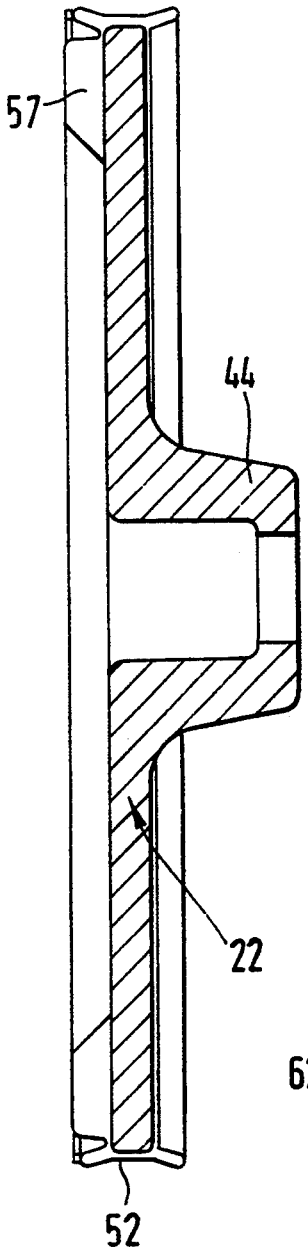
FIG. 3 is a cross section to an enlarged scale of the piston and seal of the vacuum pump shown in FIG. 2.
Figure 4:
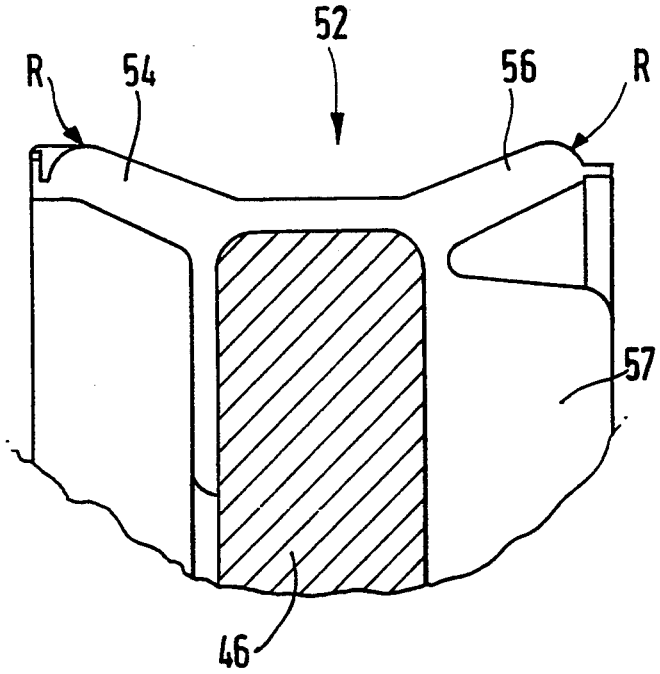
FIG. 4 shows to an enlarged scale a peripheral portion of the piston seal.

As will be seen more clearly from FIGS. 3 and 4, the piston 22 is fitted with or has bonded thereto a peripheral seal 52 of resilient material which has skirt portions 54, 56 extending axially in opposite direction to provide cone shaped sealing lands which are uni-directional in sealing action. Flexibility of the material and the cone angle are chosen to allow the pressure differential across the land to generate a sealing force without creating excessive friction losses.

The radius R of the sealing lip is chosen to allow sufficient oil to pass so as to avoid a dry edge which would cause lip damage. It will be understood that the cone shaped sealing lands allow limited play to compensate for any taper and ovality or imperfections in surface finish of the cylinder bore and also to compensate for any misalignment of the piston and cylinder.

Seal moulding flash is illustrated on the enlarged partial section of FIG. 4.

Projections 57 moulded integrally with the seal 52 are provided on one (shown) or both sides of the piston, the projects being positioned and shaped so as to occupy what would otherwise be dead spaces at top and/or bottom dead centre piston positions.

In operation with the pump mounted on the engine crank case sufficient oil spilling from the cam operated mechanism is available to lubricate the piston rod bearing. The seal is lubricated by oil that leaks directly from the bearing clearance into the cylinder space 20 and via the cross hole 50 and drilling 48 into the cylinder space 18.

The use of a seal having oppositely directly divergent skirt portions 54, 56 or sealing lands at the periphery of the seal in combination with lubrication flowpaths communicating between the bearing clearance and the spacers on opposite sides of the piston considerably facilitates manufacture of the pump yielding significant economies.

Figure 2:
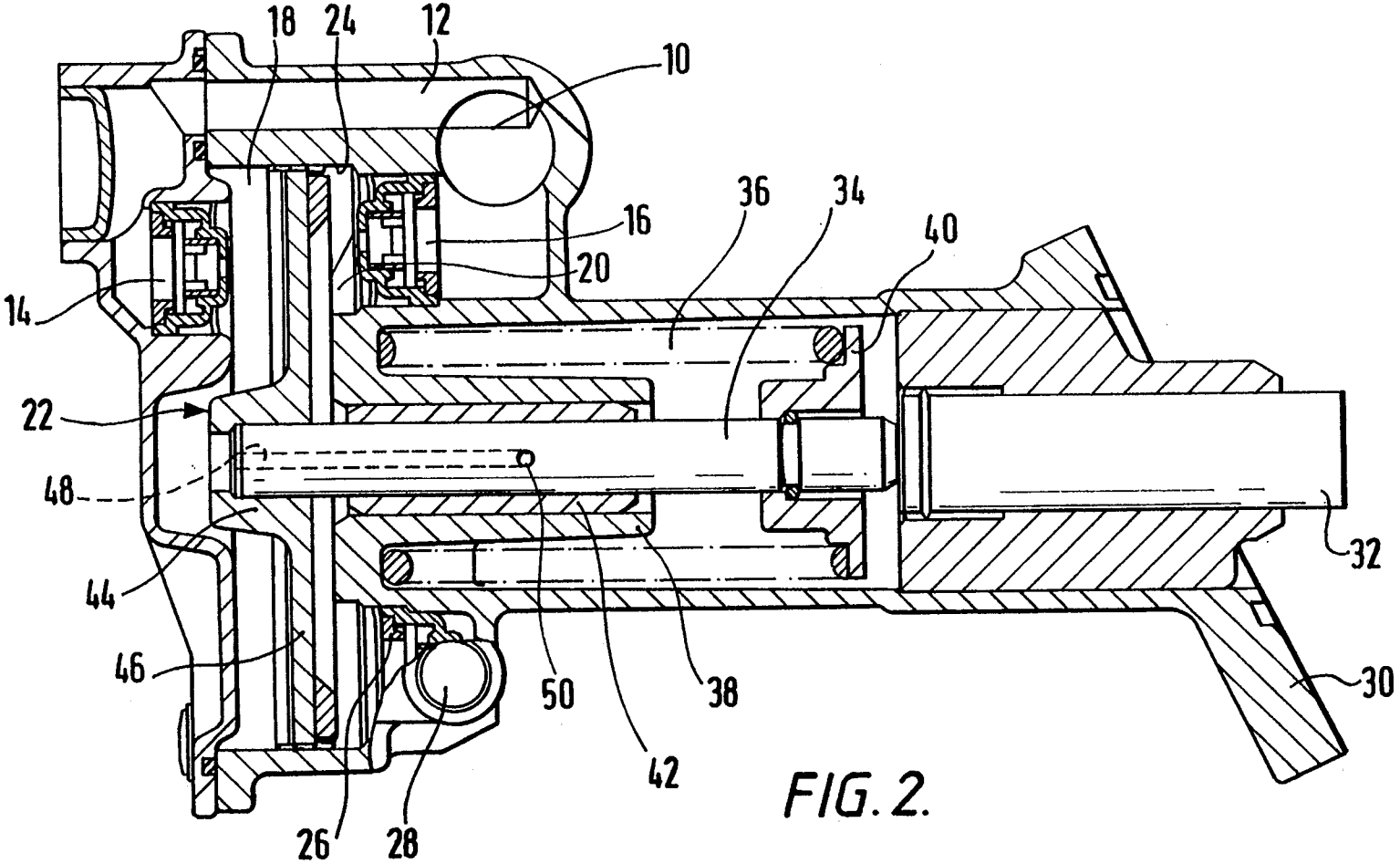
FIG. 2 is a longitudinal section of the vacuum pump shown in FIG. 1 taken on AA.

The vacuum pump of FIGS. 1 and 2 may be manufactured in a conventional manner having a cast aluminium housing in which a cylinder bore and bearing boss are machined to a high degree of accuracy so as to achieve concentricity. However, by using zinc alloy or a suitable plastics material for the body of the pump, no metal cutting processes are required, the forming processes producing the finished parts; any piston eccentricity between the cylinder bore and the piston rod bore are accommodated by the seal.

Figure 5:
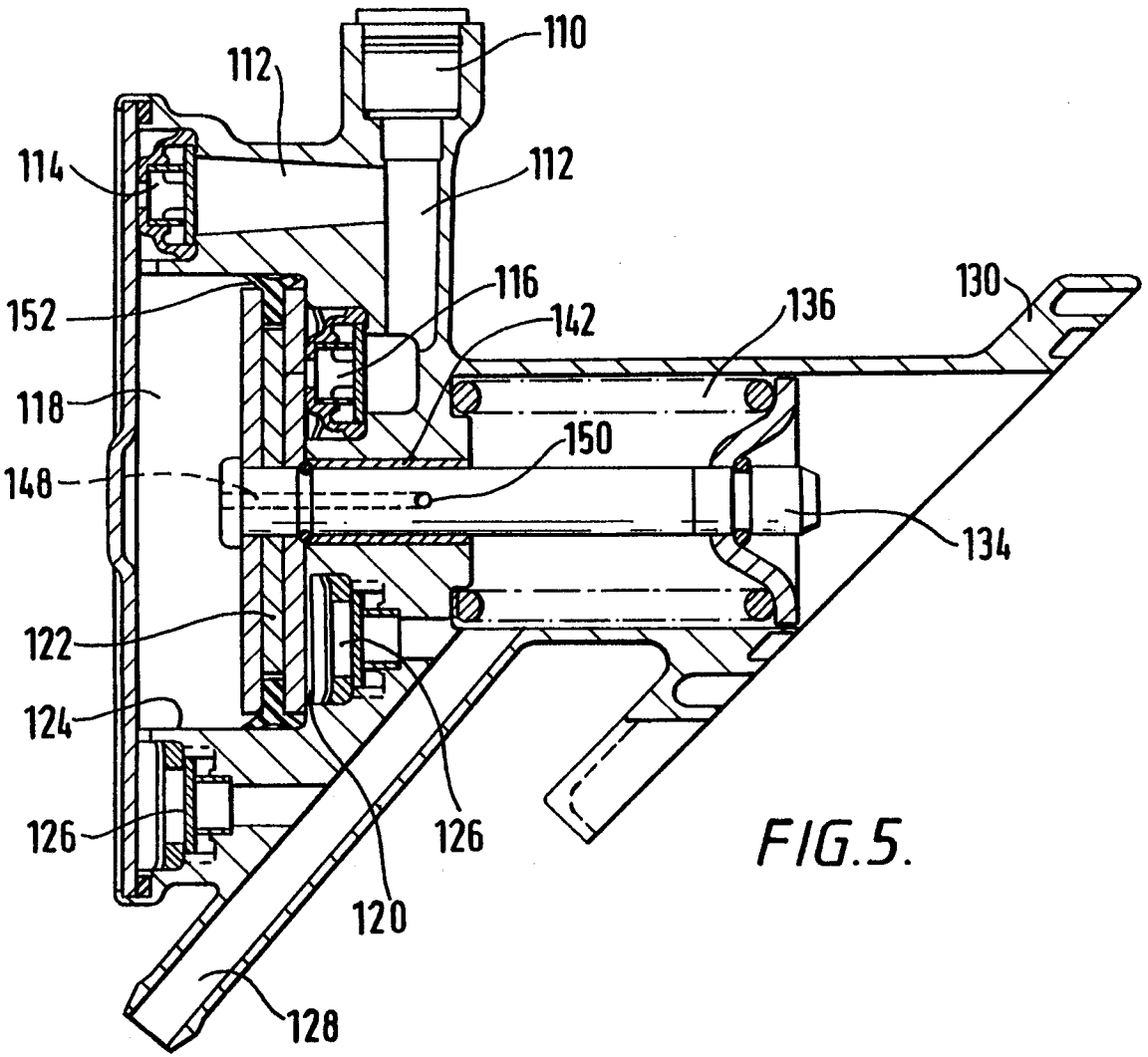
FIG. 5 is a longitudinal cross-section (corresponding to FIG. 2) of another embodiment of a vacuum pump.

In an alternative embodiment shown in FIG. 5, similar parts have reference numerals to which 100 has been added. In this embodiment the seal 152 is not bonded to the piston 122 but is substantially Y-shaped in cross section, the leg of the Y-shaped cross section being inserted in and floating in a circumferential groove around the piston rim.

Figure 6:
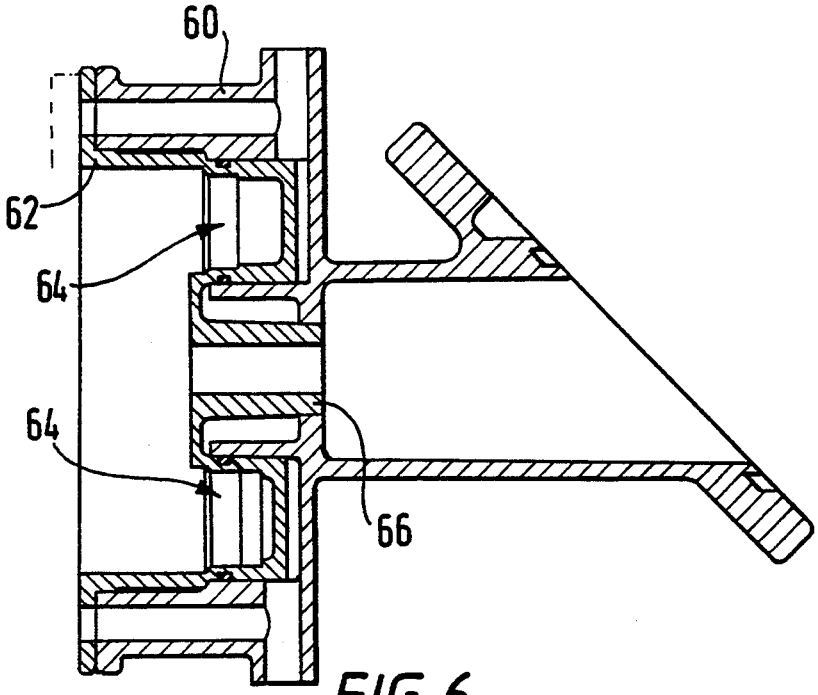
FIG. 6 is a longitudinal cross section of a further embodiment of a vacuum pump housing.

The pump housing shown in FIG. 6 is of composite construction having an aluminium housing 60 with a zinc or plastic insert or cylinder bore liner 62 including seats 64 for the valves (of 16 and 26 FIG. 2) and the piston rod bearing boss sleeve 66. The surface finish of the zinc or plastic insert 62 as cast or moulded is adequate to provide efficient pumping in combination with the lubricated seal arrangement described above.

We claim:

1. A reciprocating vacuum pump having a cylinder (24,124), a substantially disc shaped piston (22,133) reciprocal in the cylinder (24,124) and a suction port (10,110) having non-return inlet valves (14,16;114,116) located on one side of the cylinder, and a delivery port (28,128) having exhaust valves located on an opposite side of the cylinder, said piston (22,122) being driven axially by a rod (34,134) running in a lubricated bearing (42,142), said piston (22,122) having a peripheral seal (52,152) of resilient material and said seal having peripheral skirt portions (54,56) extending radially outwardly and in opposite directions, a lubrication flowpath (50,48;150,148) being provided between said bearing (42,142) and a space on the side of the piston (22,122) opposite thereto.

2. A pump according to claim 1 wherein said seal (152) is of a substantially 'Y' shaped section.

3. A pump according to claim 1 wherein in use said peripheral skirt portions (54,56) are within the radially extending envelope of said piston (22,122).

4. A pump according to claim 1 wherein said seal (52) is bonded to said piston (22).

5. A pump according to claim 4 wherein said seal (52) further includes one or more integral projections radially inwardly of said peripheral skirt portions (54,56) and extending axially of the piston (22), said one or more projections (57) reducing the unpumped volume of said cylinder (24).

6. A pump according to claim 1 wherein said lubrication flowpath comprises a cross hole (50,150) of said rod (34,134) and a hole (48,148) extending longitudinally of said rod (34,134) and communicating with said cross hole (50,150).

7. A pump according to claim 6 wherein in use said cross (50,150) hole lies within said bearing (42,142) for all positions of said piston (22,122).

8. A pump according to claim 1 and having pumping chambers (18,20;118,120) on both sides of said piston (22,122).

9. A pump according to claim 1 wherein said rod (34,134) is round and said bearing (42,142) is defined by a cylindrical aperture in the body of said pump.

10. A pump according to claim 9 wherein said bearing (42,142) is a cylindrical bush in an aperture of said body.

* * * * *